US005896738A

United States Patent [19]

Yang et al.

[11] Patent Number: 5,896,738

[45] Date of Patent: Apr. 27, 1999

[54] THERMAL CHEMICAL RECUPERATION METHOD AND SYSTEM FOR USE WITH GAS TURBINE SYSTEMS

[75] Inventors: Wen-Ching Yang, Export; Richard A. Newby, Pittsburgh, both of Pa.; Ronald L. Bannister, Winter Springs, Fla.

[73] Assignee: Siemens Westinghouse Power Corporation, Orlando, Fla.

[21] Appl. No.: 08/835,341

[22] Filed: Apr. 7, 1997

[51] Int. Cl.[6] ..... F02C 3/20; F02C 3/30

[52] U.S. Cl. ..... 60/39.05; 60/39.12; 60/39.182

[58] Field of Search ..... 60/39.02, 39.05, 60/39.12, 39.5, 39.511, 39.182, 39.23

[56] References Cited

U.S. PATENT DOCUMENTS

| | | | |
|---|---|---|---|
| 4,907,406 | 3/1990 | Kirikami et al. | 60/39.182 |
| 4,991,391 | 2/1991 | Kosinski | 60/39.182 |
| 5,133,180 | 7/1992 | Horner et al. | 60/39.12 |
| 5,428,953 | 7/1995 | Siga et al. | 60/39.182 |
| 5,431,007 | 7/1995 | Viscovich et al. | 60/39.12 |
| 5,498,370 | 3/1996 | Bhattacharyya et al. | 60/39.12 |
| 5,557,920 | 9/1996 | Kain | 60/39.23 |
| 5,590,518 | 1/1997 | Janes | 60/39.12 |
| 5,628,183 | 5/1997 | Rice | 60/39.182 |
| 5,669,216 | 9/1997 | Ankersmit et al. | 60/39.12 |
| 5,705,916 | 1/1998 | Rudbeck et al. | 60/39.12 |

*Primary Examiner*—Charles G. Freay
*Assistant Examiner*—Ted Kim

[57] ABSTRACT

A system and method for efficiently generating power using a gas turbine, a steam generating system (20, 22, 78) and a reformer. The gas turbine receives a reformed fuel stream (74) and an air stream and produces shaft power and exhaust. Some of the thermal energy from the turbine exhaust is received by the reformer (18). The turbine exhaust is then directed to the steam generator system that recovers thermal energy from it and also produces a steam flow from a water stream. The steam flow and a fuel stream are directed to the reformer that reforms the fuel stream and produces the reformed fuel stream used in the gas turbine.

15 Claims, 2 Drawing Sheets

THERMAL CHEMICAL RECUPERATION METHOD AND SYSTEM FOR USE WITH GAS TURBINE SYSTEMS

STATEMENT OF GOVERNMENT INTEREST

The U.S. Government has a paid-up license in this invention and the right in limited circumstances to require the patent owner to license others on reasonable terms as provided for by the terms of Contract No. DE-FG21-95MC32071 awarded by Department of Energy.

BACKGROUND OF THE INVENTION

1. Field of the Invention

The present invention relates to an economical method and system for generating power. More specifically, the present invention relates to a method and system for efficiently recovering thermal energy from gas turbine exhaust.

2. Description of the Related Art

Conventionally, the thermal energy recovery from gas turbine exhaust is accomplished by a recuperator, a regenerator, or a heat recovery steam generator. The sensible heat of the gas turbine exhaust is thus recovered into the sensible heat or latent heat of the inlet stream of the gas turbine. In this form of thermal energy recovery, the efficiency is limited by the temperature approach, or driving force, between the exhaust and the inlet streams.

It is therefore desirable to provide a method and system for thermal energy recovery that is less dependant upon the temperature difference between the exhaust and the inlet streams of a gas turbine.

SUMMARY OF THE INVENTION

The claimed invention provides a system and method for efficiently generating power using a gas turbine, a steam generating system and a reformer. The gas turbine receives a reformed fuel stream and an air stream and produces shaft power and exhaust. Some of the thermal energy from the turbine exhaust is received by the reformer. The turbine exhaust is then directed to the steam generator system that recovers thermal energy from it and also produces a steam flow from a water stream. The steam flow and a fuel stream are directed to the reformer that reforms the fuel stream and produces the reformed fuel stream used in the gas turbine.

DETAILED DESCRIPTION OF THE PREFERRED EMBODIMENTS

Figure 1:
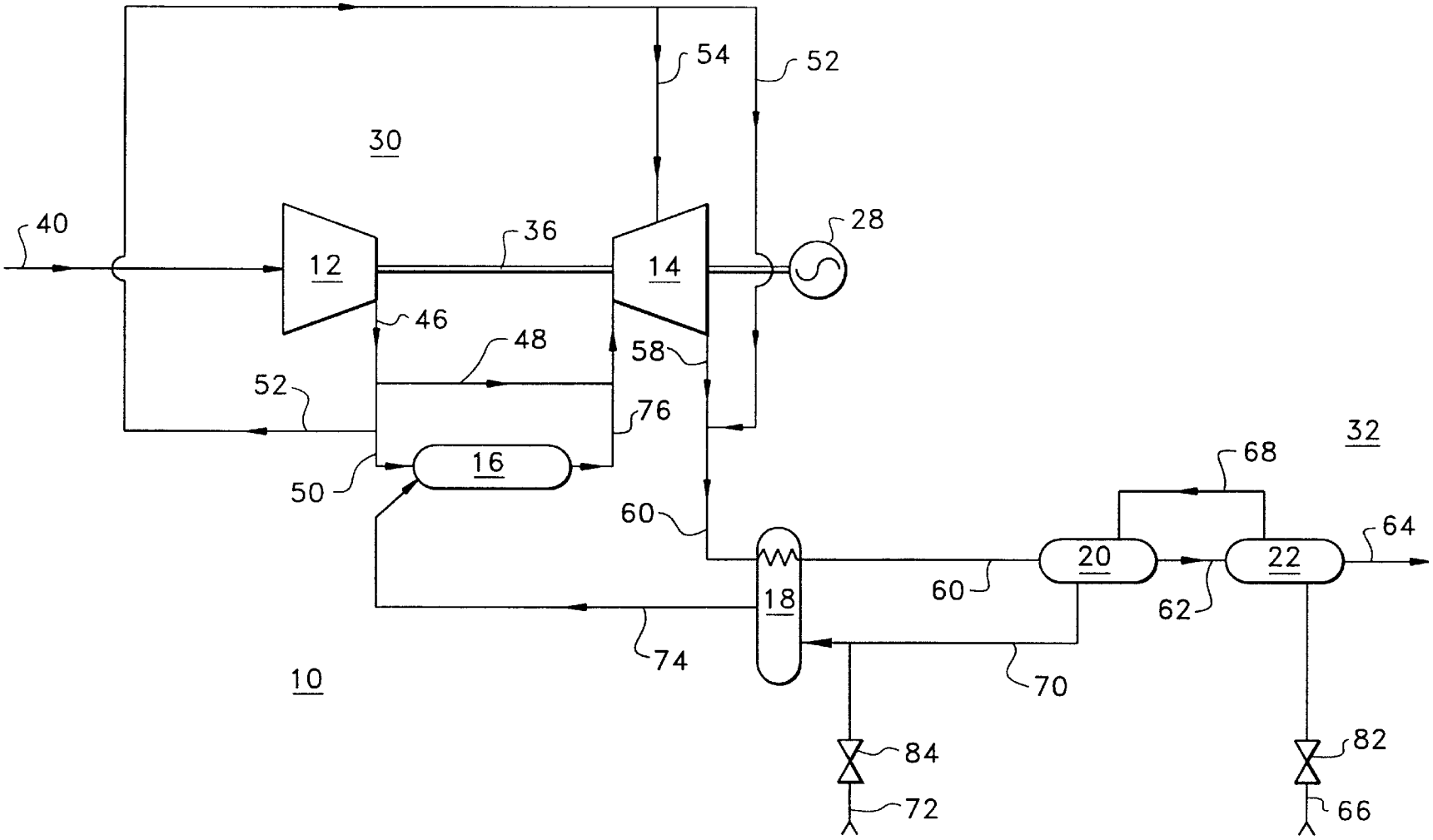
FIG. 1 is a flow chart of the thermal chemical recuperation system according to the claimed invention.

Now referring to FIG. 1, a thermal chemical recuperation power generation system 10 of the claimed invention comprises a gas turbine system 30, a steam generating system 32, and a reformer 18. The gas turbine system 30 generates power and a compressed air/turbine exhaust stream 60 from an air stream 40 and a reformed fuel stream 74. The steam generation system 32 generates a steam flow 70 and a system exhaust 64 from the compressed air/turbine exhaust stream 60 and a water stream 66. The steam flow 70 is used by a reformer 18 to reform a fuel stream 72 to produce the reformed fuel stream 74 used by the gas turbine system 30.

The gas turbine system 30 comprises a compressor 12 connected to a turbine 14 via a shaft 36 that is also connected to an electrical generator 28. The air stream 40 is directed into the compressor 12 and compressed to produce a compressed air stream 46. In a preferred embodiment of the invention, the compressor 12 may have a pressure ratio of 15. A first portion 48 of the compressed air 48 is directed to the turbine 14. A second portion 50 of the compressed air stream is directed to a combustor 16, where it is used to combust the reformed fuel stream 74 to produce a combustor exhaust stream 76. In a preferred embodiment of the invention, the oxygen concentration of the combustor exhaust stream 76 may be 6.7 mole percent. The combustor exhaust stream 76 is also directed to the turbine 14.

The turbine 14 expands the compressed air stream first portion 48 and the combustor exhaust stream 76, thus rotating the shaft 36 and driving the compressor 12 and an electrical generator 28. The expanded streams exit the turbine 14 as a turbine exhaust stream 58 and are combined with a third portion 52 of the compressed air stream 46 to form the compressed air/turbine exhaust stream 60 with thermal energy. Other embodiments of the invention may not mix the turbine exhaust stream with the third portion 52 of the compressed air stream 58. According to the embodiment of the invention shown in FIG. 1, the turbine 14 is cooled by a cooling compressed air stream 54 that splits off from the compress air stream third portion 52. Other embodiments of the invention may have other means for cooling the turbine 14.

The steam generation system 32 of the embodiment of the invention shown in FIG. 1 comprises an evaporator 20 and a economizer 22. The compressed air/turbine exhaust stream 60 is directed into the evaporator 20 where it heats a heated water stream 68 to produce the steam flow 70. The now cooled compressed air/turbine exhaust stream 62 is then directed from the evaporator 20 into the economizer 22 where it heats the water stream 66 to produce the heated water stream 68. The now much cooler compressed air/turbine exhaust stream exits the economizer 22 as the system exhaust 64. In a preferred embodiment of the invention, the flow rate of the water stream 66 may be adjusted with valve 82 in the line to generate a temperature difference of approximately 18° F. between the cooled compressed air/turbine exhaust stream 62 and the heated water stream 68.

As previously discussed, the reformer 18 receives the steam flow 70 and the fuel stream 72 to produce the reformed fuel stream 74 used by the gas turbine system 30. The fuel stream 72 comprises any fuel that is reformable and enables the reformer 18 to produce a reformed fuel stream 74 that is combustible in the combustor 16. In an embodiment of the invention, the fuel stream may be natural gas, liquefied natural gas, synthetically-derived hydrocarbon fuel, or a mixture thereof. In a preferred embodiment of the invention, the flow rates of the steam flow 70 and a fuel stream 72 of natural gas may be adjusted by valves 82 and 84 in the respective lines to maintain a steam-to-natural-gas mass ratio thereof of approximately 6.5 and a methane-to-carbon-monoxide conversion of approximately 59.6%. In an embodiment of the invention, the temperature of the reforming process may be between approximately 400° F. and 1100° F., however, a suitable catalyst for the reformer 18 and temperature range for reforming the fuel is determined based upon the fuel being reformed.

To achieve the requisite temperatures range to operate the reformer 18, the compressed air/turbine exhaust gas stream 60 passes through a closed heat exchange means in the reformer 18 to deliver thermal energy from the stream 60 to the, reformer 18. In the preferred embodiment of the invention, the compressed air/turbine exhaust gas stream 60 is approximately 36° F. hotter than the reformed fuel stream 74, which is a relatively low temperature approach or driving force.

Figure 2:
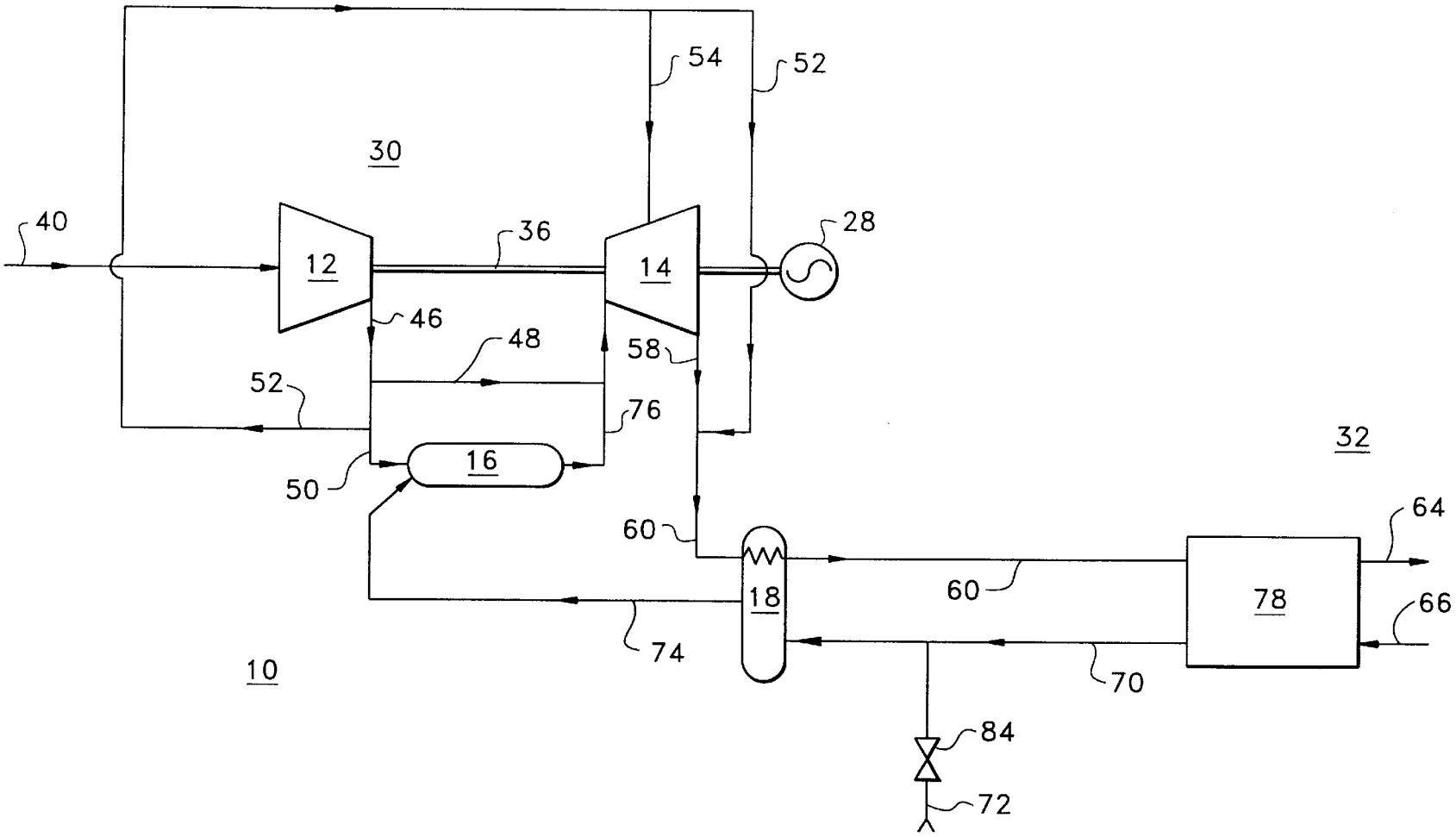
FIG. 2 is a flow chart of the thermal chemical recuperation system incorporated into an electricity-steam cogeneration plant.

Other embodiments of the invention may use other means to provide the steam 70 for reforming the fuel stream 72. In the embodiment of the invention shown in FIG. 2, the power generation system 10 is part of an electricity-steam cogeneration plant. The steam generation portion 78 of the cogeneration plant receives the compressed air/turbine exhaust stream 60 after some of its thermal energy has been removed by the reformer 18. The steam generation portion 78 recovers more thermal energy from the compressed air/turbine exhaust stream 60. The steam generation portion 78 also provides the steam flow 70 for reforming the fuel 72.

The claimed invention provides an efficient power generation system and device. The thermal chemical recuperation cycle 10 had a net cycle efficiency of 48.85% on an APSEN PLUS simulation thereof, compared to the efficiencies of 35.91% and 45.63% for a simple cycle gas turbine cycle and a steam injected turbine cycle respectively. Further, the thermal chemical recuperation cycle of the current invention has lower $NO_x$ emissions. This is a result of the hydrogen-rich reformed fuel stream 74 having extended the flammability limits, and tolerating relatively large amounts of steam (not shown) to enter into the combustor 16 and lower the flame temperature.

Although the present invention has been discussed with reference a steam generation means comprising an evaporator/economizer system or a cogeneration plant, any means that provides steam to the reformer using thermal energy from the turbine exhaust is suitable for practicing the claimed invention. Further, any means that provides thermal energy from the turbine exhaust to the reformer is suitable for practicing the claimed invention. Consequently, the present invention may be embodied in other specific forms without departing from the spirit or essential attributes thereof and, accordingly, reference should be made to the appended claims, rather than to the foregoing specification, as indicating the scope of the invention.

We claim:

1. A power generating system comprising:

a) combustor means for receiving a reformed fuel stream and a first portion of a compressed air stream and producing a combustor exhaust stream;

b) gas turbine means for receiving at an input a combination of the combustor exhaust stream and a second portion of the compressed air stream, which has bypassed the combustor, and producing shaft power and a turbine exhaust stream having thermal energy therefrom, the turbine exhaust stream being combined with a third portion of the compressed air stream upstream of a reforming means;

c) steam generating means for receiving said combined turbine exhaust and compressed air stream and a water stream and producing a steam flow and a system exhaust stream therefrom; and d) said reforming means receiving a fuel stream, said steam flow, and a portion of said combined turbine exhaust and compressed air stream thermal energy, and producing said reformed fuel stream therefrom.

2. The system of claim 1, wherein said fuel stream is natural gas, liquefied natural gas, synthetically-derived hydrocarbon fuel, or a mixture thereof.

3. The system of claim 1, wherein said steam generating means comprises:

a) evaporator means for receiving said combined turbine exhaust and compressed air stream and a heated water stream and producing said steam flow and a cooled combined turbine exhaust and compressed air stream therefrom;

b) economizer means for receiving said cooled combined turbine exhaust and compressed air stream and said water and producing said heated water stream and said system exhaust stream therefrom; and c) water control means for adjusting a flowrate of said water stream.

4. The system of claim 1, wherein said power generating system is an electricity-steam cogeneration plant.

5. The system of claim 1, wherein said gas turbine means comprises:

a) compressor means for receiving an inlet air stream and producing the compressed air stream therefrom; and b) directing means for splitting of the third portion of said compressed air stream and for combining said compressed stream third portion with said turbine exhaust stream.

6. The system of claim 1, wherein said reforming means comprises:

a) a reformer with heat exchange means for receiving said combined turbine exhaust and compressed air stream thermal energy; and b) fuel control means for adjusting a flowrate of said fuel stream.

7. A method for generating power comprising the steps of:

a) compressing an air stream to produce a compressed air stream;

b) burning a reformed fuel stream in a first portion of said compressed air stream to produce a combustor exhaust stream;

c) expanding in combination said combustor exhaust stream and a second portion of said compressed air streamer which has by-passed the combustor, throughout a turbine means for producing shaft power and a turbine exhaust stream having thermal energy, the turbine exhaust stream being combined with a third portion of said compressed air stream upstream of a reformer;

d) reforming a fuel stream with a steam flow and a first portion of said combined turbine exhaust and compressed air stream thermal energy to produce said reformed fuel stream; and e) generating said steam flow by heating a water stream with a second portion of said combined turbine exhaust and compressed air stream thermal energy.

8. The method of claim 7, wherein said generating said steam flow step further comprises the steps of:

a) directing said combined turbine exhaust and compressed air stream and a heated water stream into evaporator means for producing said steam flow and a cooled combined turbine exhaust and compressed air flow therefrom; and b) directing a water stream and said cooled combined turbine exhaust and compressed air stream into economizer means for producing said heated water stream and a system exhaust stream therefrom.

9. The method of claim 8, wherein said generating said steam flow step further comprises the step of adjusting a flow rate of said water stream to generate temperature difference of approximately 18° F. between said cooled combined turbine exhaust and compressed air stream and said heated water stream.

10. The method of claim 7, wherein said reforming step further comprises the step of reforming a fuel stream of natural gas, liquefied natural gas, synthetically-derived hydrocarbon fuel, or a mixture thereof.

11. The method of claim 10, wherein said reforming step further comprises the step of adjusting flow rates of said steam flow and said fuel stream of natural gas such that the steam-to-natural-gas mass ratio thereof is approximately 6.5.

12. The method of claim 11, wherein said reforming step further comprises the steps of:

a) reforming said fuel stream of natural gas comprising methane; and b) converting approximately 59.6 mole % of said methane to carbon monoxide.

13. The method of claim 7, wherein said reforming step occurs between approximately 400° F. and 1100° F.

14. The method of claim 7, wherein said compressing step further comprising the step of compressing said air stream first portion to a pressure ratio of approximately 15.

15. The method of claim 7, wherein said burning step further comprises the step of producing said combustor exhaust stream comprising approximately 6.7 mole % oxygen.

* * * * *